United States Patent [19]

Trolle

[11] 4,008,659

[45] Feb. 22, 1977

[54] FRAME FOR PRESSES AND SIMILAR MACHINES

[75] Inventor: Sten Trolle, Ystad, Sweden

[73] Assignee: AB Carbox, Ystad, Sweden

[22] Filed: Aug. 8, 1975

[21] Appl. No.: 603,017

[30] Foreign Application Priority Data

Aug. 30, 1974 Sweden ..... 7411039

[52] U.S. Cl. ..... 100/214; 72/455; 100/269 R

[51] Int. Cl.[2] ..... B30B 15/04

[58] Field of Search ..... 72/455, 450; 100/214, 100/269 R, 295

[56] References Cited

UNITED STATES PATENTS

| | | | |
|---|---|---|---|
| 1,422,779 | 7/1922 | Perony | 72/450 |
| 2,786,410 | 3/1957 | Bakewell | 100/214 |

*Primary Examiner*—Billy J. Wilhite
*Attorney, Agent, or Firm*—Flynn & Frishauf

[57] ABSTRACT

A frame for heavy machines, particularly presses for extremely high pressures having the press tools mounted on vertically extending columns of the machine frame so that actuating of the press involves a horizontal relative movement of the tools, includes an upper beam, or yoke, which is movable into an open position by a movement comprised of an initial raising of the yoke out of force-transmitting engagement with the tops of the vertically extending frame columns and by a subsequent horizontal movement, preferably a swinging movement, into a position where the gap between the tools is accessible.

9 Claims, 3 Drawing Figures

FRAME FOR PRESSES AND SIMILAR MACHINES

The present invention relates to a frame for presses, and similar machines, which frame in the operation of the machine forms a closed loop then absorbing the reactional forces generated in the treatment of the workpiece. When the machine is not operating, the frame can be opened for the purpose of permitting or facilitating insertion and removal of the workpiece which is treated between tools carried by vertical portions of the frame. The vertical frame portions are secured to a lower horizontal beam of the frame while the upper horizontal portion of the frame can easily be disconnected from the rest thereof.

When the treatment of the workpiece requires very high forces the frame of the machine must necessarily form a closed loop since such a configuration represents the only realistic possibility of constructing a frame which at reasonable dimension has such a strength that it can absorb the very high reactional forces generated in operation. When the workpiece is annular it is naturally absolutely necessary that the frame can be opened but also in many other cases the corresponding possibility is of great value, e.g. when the cross-section of the workpiece at one or both sides of the spot to be treated exceeds the maximum achievable from distance between the tools carried by the frame.

In conventional presses having a loop-shaped frame, often referred to as portal presses, the workpiece is treated between a lower fixed working table and an upper tool which can reciprocate in a vertical direction and is as a rule carried by a beam at its both ends actuated upon by hydraulic cylinders acting between the beam and the vertical frame portions. The vertical portions may be constituted by one or more columns at each side of the press and, in modern machines for extremely high pressures, each of them is shaped like an oval frame provided with a winding of tension-biased wires or tapes. A common characteristic of the conventional portal presses is, however, that the frame loop may be opened by a tilting movement of one of the lateral frame columns.

As was mentioned above, a machine of the type to which the present invention pertains has its tools mounted on the vertical portions of a closed frame. Accordingly, as far as the positions of the tools are concerned, the machine could be looked upon as a portal press the frame of which has been rotated by 90° around a horizontal axis so that the working movement of the tools will be in a horizontal rather than a vertical direction. However, should one try in such a machine to apply the same solution as that used in portal presses the result would be that the swingable frame portion would be positioned at the top of the frame. However, since the height of such a machine is often relatively great and as each individual portion of the frame has a weight of several tons, it is realized that such an arrangement would involve considerable handling difficulties. Another disadvantage is that such a design would call for a great clearance between the top of the machine frame and the celing of the building in which it is installed.

SUMMARY OF THE INVENTION

The object of the present invention is to provide a machine frame not suffering from the disadvantages and shortcomings above discussed. According to the main characteristic of the invention, the vertical portions of the frame are secured to the bottom horizontal portion of the frame, whereas the top horizontal portion may be open. In its normal position the movable top portion of the frame is in a force-transmitting mode connected to the other portions of the frame. From that position it may be a parallel movement be raised to a top position where the force-transmitting connection is broken and in which it may, by a swinging movement in a horizontal plane, be brought into its opened position.

BRIEF DESCRIPTION OF THE DRAWINGS

One embodiment of the invention will now be described in greater detail with reference to the drawing, illustrating a press for very high pressures.

DETAILED DESCRIPTION OF ILLUSTRATED EMBODIMENT

Figure 1:
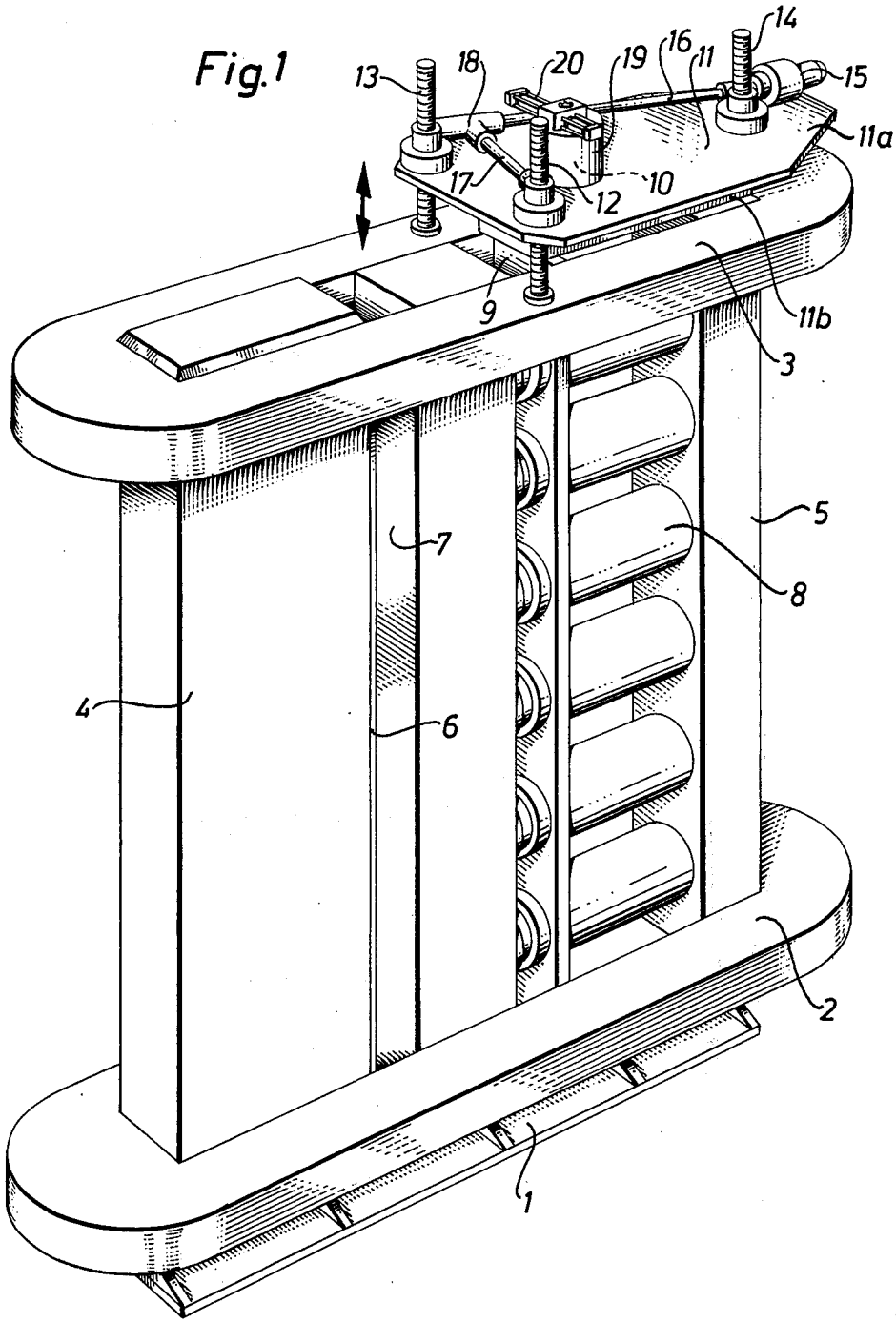
FIG. 1 shows a perspective view of a high pressure press with its frame in its normal position for operation.
Figure 2:
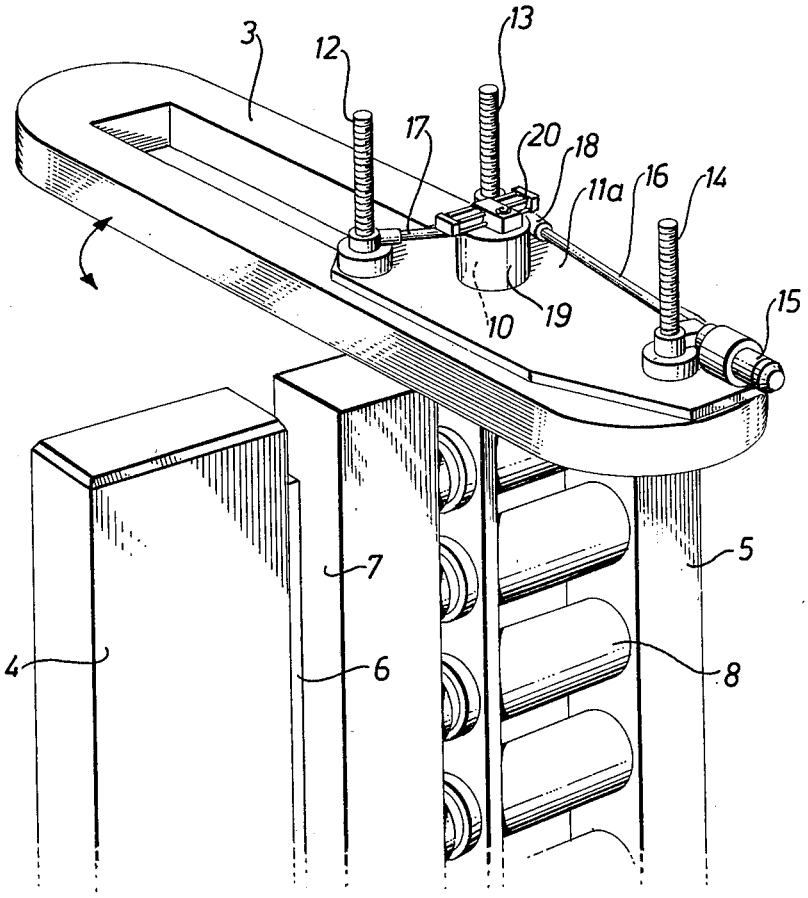
FIG. 2 corresponds to FIG. 1 but shows the press frame in its opened position.

The press frame which is carried by a foot 1 comprises four main portions, a lower horizontal portion 2, an upper horizontal portion 3, an inner beam 4 and an outer beam 5. When the press is treating annular or ring-shaped workpieces column 4 will be located inside the ring of the workpiece which fact explains why beams, or columns, 4 and 5 have been referred to as "inner" and "outer". Each of frame portions 2 and 3 comprises an oval frame which in turn substantially comprises a bobin having a multiplicity of tension-biased wires or tapes. The side of column 4 facing column 5 carries the fixed tool or die 5. The movable tool 7 is reciprocable towards and from die 6 by means of a number of hydraulic working cylinders 8 acting between column 5 and tool 7.

The top of column 5 has a heavy extension or arm 9 directed towards column 4 and partly enclosed by bobin 3. This extension 9 is just partially visible on the drawing. At its free end it carries a vertical pivot 10 which likewise is of rather heavy dimensions. A platform 11 having an upper deck **11*a* and a lower base 11*b* is rotatable around pivot 10. The contour of base 11*b*, as seen in a plan view, corresponds to the contour of the opening of the adjacent part of bobin 3. This means that when frame portion 3 is, in a way described below, raised from its normal force-transmitting position into its top position, it will be above frame 5 and will surround base 11*b* in the same way as it did in its normal working position surround the above-mentioned extension 9 of column 5**.

Platform 11 forms a deck **11*a* carrying auxiliary equipment for carrying out the lifting and swinging movements of frame portion 3. According to the illustrated embodiment of the invention the auxiliary equipment comprises three screw jacks 12, 13 and 14 which can be driven synchronously by an electric motor 15 via drive shafts 16, 17 and an angle gear 18. The bottom ends of the jack shafts are secured to frame portion 3 and the nuts in engagement with the shafts are driven by motor 15. The nuts are accordingly rotatable relative to the platform 11** but axially not displaceable in relation thereto.

Rotation of nuts raises and lowers the frame portion 3 relative to the platform 11, depending upon the direction of rotation of the nuts.

Figure 3:
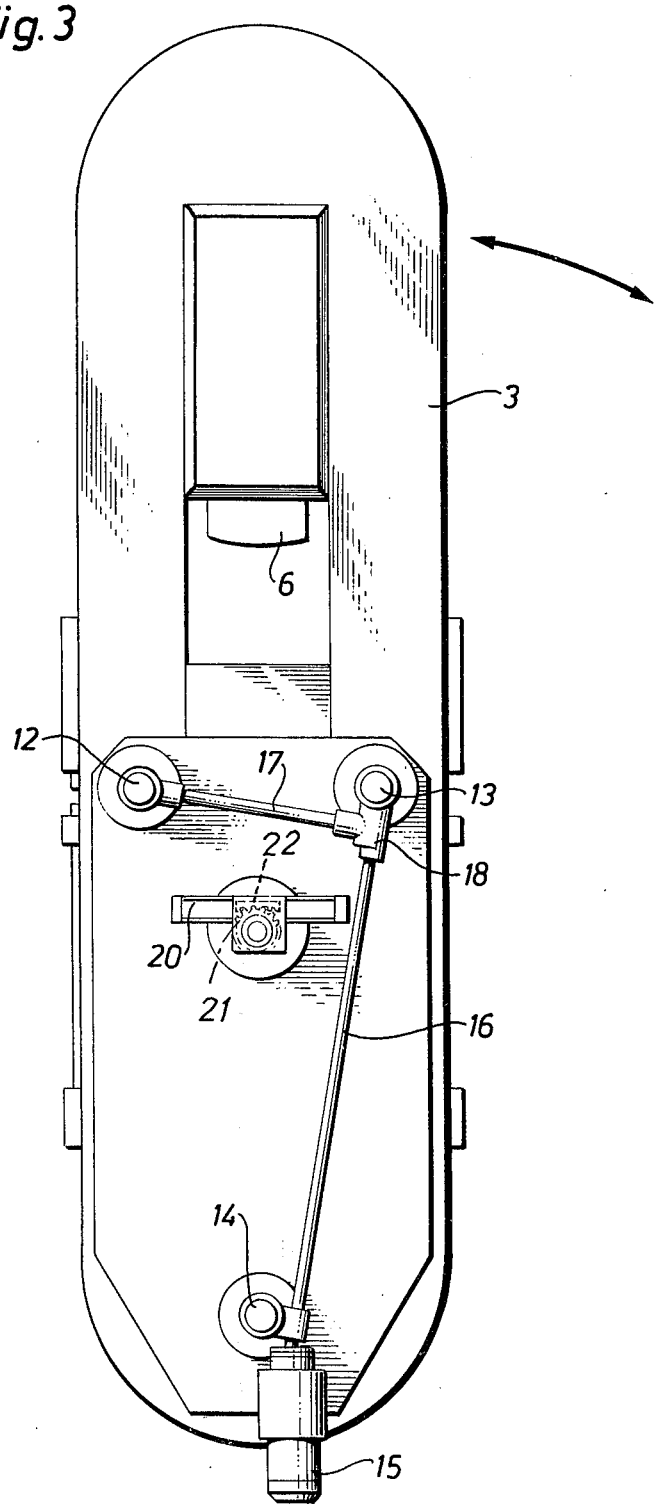
FIG. 3 is a top view of the press of FIG. 1.

Pivot 10 is accordingly rigidly connected to column 5 and thus also to frame portions 2 and 4. It is surrounded by a sleeve 19 rotatable around the pivot 10 and at its bottom edge secured to deck 11*a*. At as shown in FIG. 3, at the top end of the sleeve 19 it carries a tooth wheel 21 secured thereto and meshing with a rack 22 which is reciprocable by means of a double-acting hydraulic cylinder 20.

While the operation of the arrangement should be apparent from the above description of its structure and nature given in conjuction with the drawing, some supplementary remarks will be made for the purpose of completeness. As is understood, by means of the screw jacks 12, 13 and 14 it is possible to raise frame portion 3 from its normal position shown in FIG. 1 into an elevated position in which frame portion 3 is still exactly above the rest of the frame but from a force-transmitting point of view disconnected therefrom. By means of hydraulic cylinder 20 the unit formed by frame portion 3 and platform 11 may then be swung laterally, thereby offering access to the top opening of the slot between tools 6 and 7. It is directly realized that these movements can be achieved by means of auxiliary equipment of other types than those here described.

What is claimed is:

1. A frame for presses, and similar machines, which in the operational state of the machine forms a closed loop and which in the passive state of the machine may be opened so as to permit or facilitate the insertion or removal of workpieces to be treated between tools carried thereby, comprising:

a horizontal bottom frame portion;

at least two spaced vertically extending frame parts permanently secured to said horizontal bottom frame portion and including means for carrying said tools with a workpiece receiving space therebetween;

a horizontal top portion movable between an operative position, in which it is operatively engaged with the tops of the vertically extending frame parts, and an open position in which the opening of the space formed between said tools is accessible; and opening means coupled at least to said frame top portion to shift said frame top portion into its open position, and including means for first raising said frame top portion out of engagement with the tops of said vertically extending frame parts and means for displacing said frame top portion in a generally horizontal direction.

2. A machine frame as claimed in claim 1, wherein said displacing means of said opening means includes means to displace said frame top portion by a swinging movement thereof in a generally horizontal plane.

3. A machine frame as claimed in claim 2, comprising a pivot carried by one of said vertical frame portions, said frame top portion being swingably mounted on said pivot.

4. A machine frame as claimed in claim 3 including a platform mounted above said frame top portion and supporting said opening means.

5. A machine frame as claimed in claim 4 wherein said platform has a lower base portion which engages said frame top portion when said frame top portion is vertically moved out of engagement with the tops of said vertically extending frame parts.

6. A machine frame as claimed in claim 5 wherein said platform carries means pivotally engageable with said pivot, and wherein said opening means includes means coupled to said pivot and to said pivot means for imparting said swinging motion to said frame top portion and to said platform.

7. A machine frame as claimed in claim 1 including a platform mounted above said frame top portion and supporting said opening means.

8. A machine frame as claimed in claim 7 wherein said platform has a lower base portion which engages said frame top portion when said frame top portion is vertically moved out of engagement with the tops of said vertically extending frame parts.

9. A machine frame as claimed in claim 1, wherein said frame top portion is shaped like a loop closed in a horizontal plane and is provided with a winding of tension-biased wires or tapes.

* * * * *